US007448772B2

(12) United States Patent
Hampton

(10) Patent No.: US 7,448,772 B2
(45) Date of Patent: Nov. 11, 2008

(54) MOUNTING ADAPTOR APPARATUS FOR LEDS

(75) Inventor: Steve Hampton, Mustang, OK (US)

(73) Assignee: Little Giant Pump Company, Oklahoma City, OK (US)

( * ) Notice: Subject to any disclaimer, the term of this patent is extended or adjusted under 35 U.S.C. 154(b) by 207 days.

(21) Appl. No.: 11/479,083

(22) Filed: Jun. 30, 2006

(65) Prior Publication Data

US 2007/0008723 A1 Jan. 11, 2007

Related U.S. Application Data

(60) Provisional application No. 60/696,100, filed on Jul. 1, 2005.

(51) Int. Cl.
*F21V 11/00* (2006.01)

(52) U.S. Cl. ..... 362/240; 362/646; 362/659; 362/800

(58) Field of Classification Search ..... 362/240, 362/646, 659, 800
See application file for complete search history.

(56) References Cited

U.S. PATENT DOCUMENTS

2004/0105264 A1 6/2004 Spero
2005/0128751 A1 6/2005 Roberge et al.

OTHER PUBLICATIONS

International Search Report for PCT/US06/25972 dated Jul. 12, 2007.
Written Opinion for PCT/US06/25972 dated Jul. 12, 2007.
Representative illustrations of conventional PCB/LED array assemblies, as contemplated in accordancce with the invention.

*Primary Examiner*—Sandra L. O'Shea
*Assistant Examiner*—Meghan K. Dunwiddie
(74) *Attorney, Agent, or Firm*—Marshall, Gerstein & Borun LLP

(57) ABSTRACT

An apparatus for mounting an assembly comprising light emitting diodes (LEDs) or other light producing components mounted on one or more printed circuit boards (PCBs) in a light housing designed to accept a standardized light producing bulb comprising a mounting adapter designed so that the pcb can snap/lock into position in the adapter and the adapter can mount into the housing in the manner of a standard bulb.

3 Claims, 4 Drawing Sheets

MOUNTING ADAPTOR APPARATUS FOR LEDS

RELATED APPLICATIONS

The present application claims priority to U.S. Provisional Application No. 60/696,100 filed Jul. 1, 2005, entitled LED Mounting Assembly In Light Housing.

BACKGROUND OF THE INVENTION

1. Field of Invention

The present invention relates generally to the field of mounting structures for electrical components, and more particularly but not by way of limitation, to a mounting adaptor apparatus for LEDs in a housing by which light producing components on a printed circuit board are secured.

2. Discussion

Functional illuminating devices find wide usage in this country and in nations abroad for the purpose of safety and artistic highlighting of all types of objects and areas. Examples of such are numerous in both commercial and domestic markets, e.g., industrial and residential yards, swimming pools, walkway, etc. One type of these illuminating devices is a light system that has a protective housing and a standardized incandescent bulb, such as an MR16 bulb, together with a colored lens or colored filter for the achievement of colored light emission (illustrated below in FIG. 1). While being very useful, such light systems do not offer flexibility for changing the color of light illumination following installation.

A known modification to these systems has a housing and a reflector made from the same standardized reflector assembly but with the incandescent filament replaced by an array of light emitting diodes (LEDs) that, when energized, produce a selected color determined solely by the choice of assembled LEDs, discussed below and illustrated below in FIG. 1A. The use of a standard reflector in such systems limited the available space for the light producing components.

There is a need for an apparatus that will convert existing lighting fixtures to be capable of utilizing LED technology, and as well, that will be usable in existing housings for use in new lighting installations.

SUMMARY OF THE INVENTION

The present invention provides an assembly comprising an LED mount that is positionable to replace a standard reflector, permitting the mounting of arrays of LEDs on a printed circuit board (PCB). The assemblage of LEDs and PCB are then usable in a housing of the type formerly used to support an incandescent bulb and the like.

Thus, the present invention provides an apparatus for mounting an assembly of light emitting diodes (LEDs) or other light producing components mounted on one or more printed circuit boards (PCBs) in a light housing designed to accept a standardized light producing bulb, comprising a mounting adapter designed so that the PCB can snap/lock into position in the adapter and the adapter can mount into the housing in the manner of a standard bulb.

In one preferred embodiment, the present invention is a lighting fixture comprising a housing configured to support a light producing bulb, a means supporting LED light producing components having a mounting adaptor profiled generally to the profile shape of the bulb, and an array assembly supported in the mounting adaptor, the mounting adaptor and array assembly together supported in the housing.

The features, benefits and advantages of the present invention will become apparent from the following detailed description when read in conjunction with the drawings and appended claims.

DISCUSSION

Figure 1:
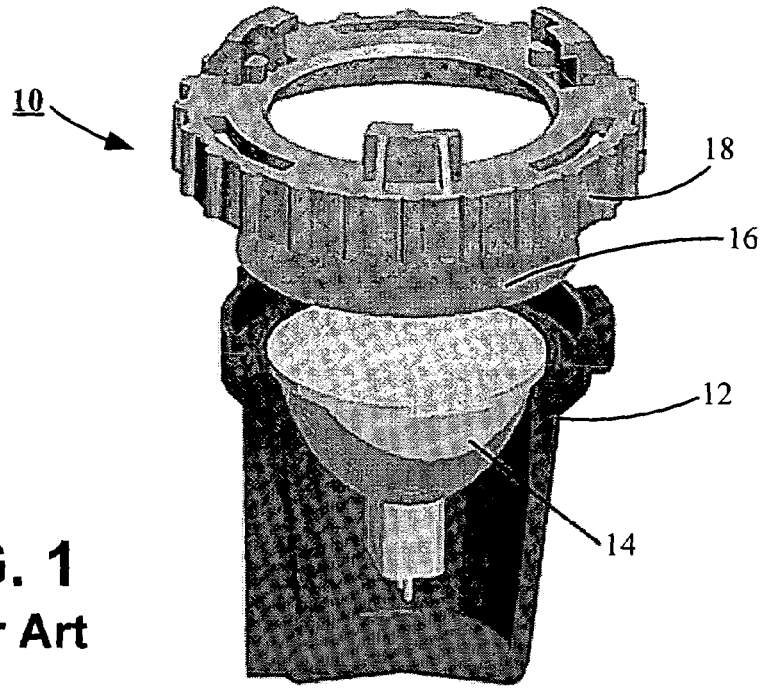
FIG. 1 Prior Art
FIG. 1 is a partial cutaway view of a conventional lighting fixture having a housing in which is supported an incandescent bulb.

For a clear understanding of the environment of the present invention, the reader's attention is directed to FIG. 1 in which is shown a conventional lighting fixture 10 that has a housing 12 in which is supported an incandescent lamp 14, such as for example, a commercially available and widely used type MR 16 lamp. A translucent, colored, or a clear, lens 16 is supported in juxtaposition to the emitting surface of the bulb 14, with the color or clearness of the bulb 14 determining the color of the light that is passed there through. Preferably, a locking ring 18 is received on mating, protruding locking lugs on the housing 12 to secure the lens 16.

Figure 1A:
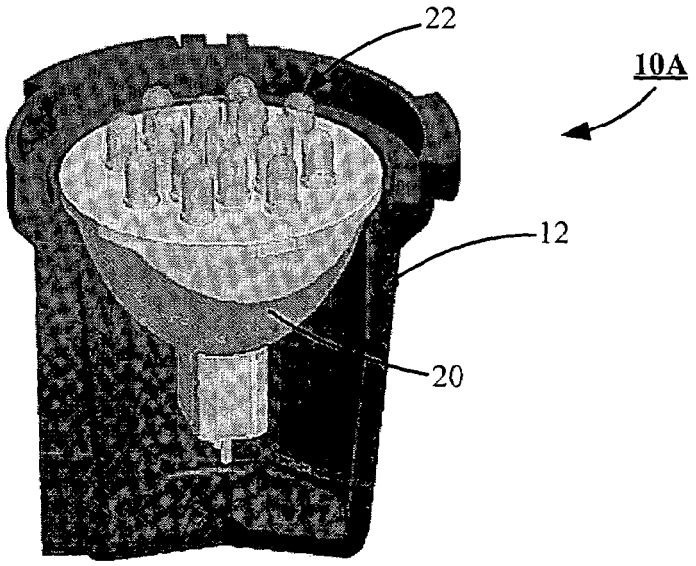
FIG. 1A Prior Art
FIG. 1A is a partial cutaway view of another conventional lighting fixture, similar to that of FIG. 1, but the incandescent filament of the bulb has been replaced by LEDs.

FIG. 1A shows a similar lighting fixture 10A in which a different lamp 20 is supported in the housing 12. The lamp 20, also commercially available, has an LED array 22 replacing the usual filament of the bulb. While the locking ring 18 is not shown in FIG. 1A, it will be understood that such secures the lamp 20 and LED array 22. Instead of a lens like the lens 16 of the lighting fixture 10, the type of LED selected for the LED array 22 determines the color of the emitted light.

Figure 2:
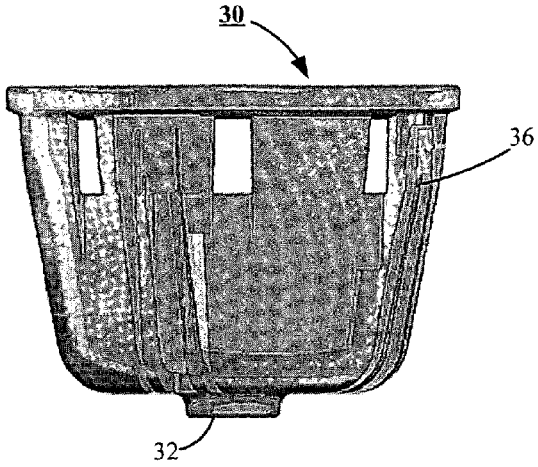
FIG. 2 is an elevational view of an LED mounting adaptor apparatus constructed in accordance with the present invention.
Figure 2A:
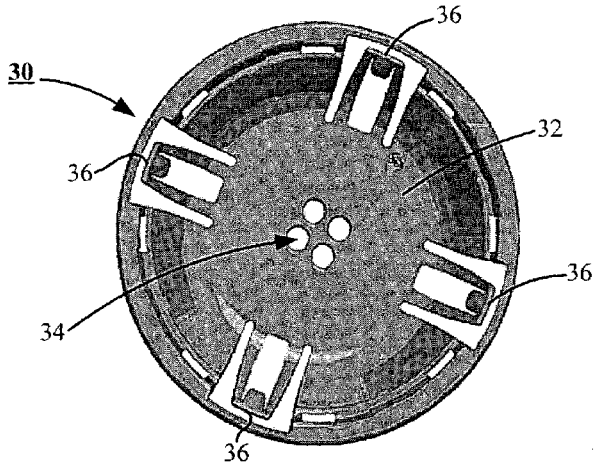
FIG. 2A is a top, plan view of the mounting adaptor apparatus of FIG. 2.
Figure 2B:
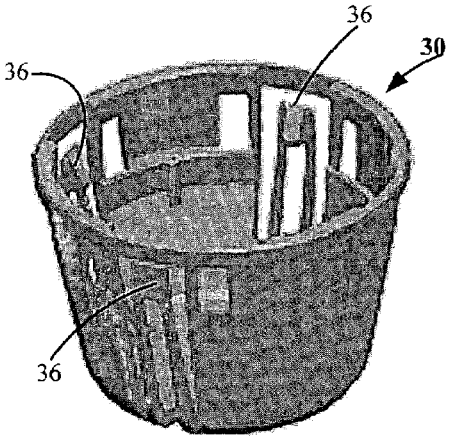
FIG. 2B is a perspective view of the mounting adaptor apparatus of FIG. 2.

Turning now to FIGS. 2 through 2B, shown therein is an LED mounting adaptor apparatus 30 constructed in accordance with the present invention, and which adapts the housing 12 to receive different light producing components. The mounting adaptor 30 is generally basket shaped, preferably made of a rigid or semi-rigid polymeric material that forms a nest for a bulb, and having a plurality of holes in the sides thereof for air circulation and heat dissipation.

The dimensions of the mounting adaptor 30 are preferably established to be received within the housing 12 or a similar housing. The mounting adaptor 30 has a bottom portion 32 that has several holes 34 as necessary for passage there through of electrical leads. Along the walls of the mounting adaptor 30 are flexible, cantilevered locking tabs 36 that are best shown in FIG. 2B.

Figure 3:
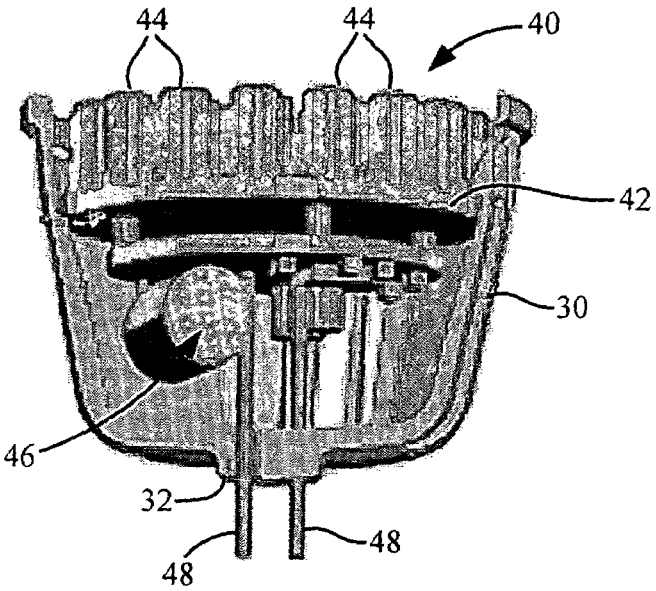
FIG. 3 is an elevational, partial cutaway view of the mounting adaptor apparatus of FIG. 2 in which is supported an LED array mounted on a printed circuit board (PCB).
Figure 3A:
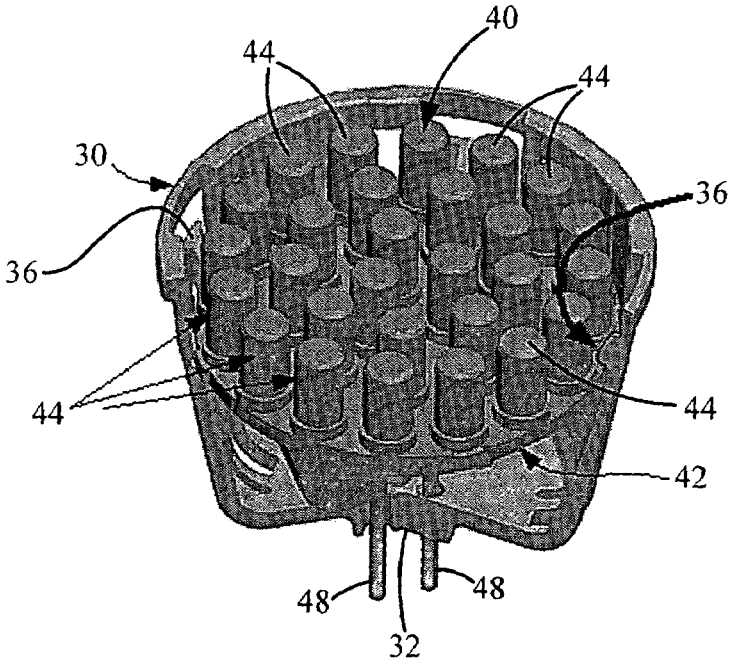
FIG. 3A is a partial cutaway, perspective view of the mounting adaptor apparatus and components of FIG. 3.

FIGS. 3 and 3A show the mounting adaptor 30 with a PCB and LED array assembly 40 disposed therein. The PCB and LED array assembly 40 comprises a printed circuit board (PCB) 42 that is shaped and sized to fit within the LED mounting adaptor apparatus 30 and secured therein by means of the locking tabs 36. The PCB and LED array assembly 40 has a plurality of light emitting diodes (LEDs) 44 that are mounted on the PCB 42 and electrically energized by an electronic circuit 46 that is mounted on the opposing side of the PCB 42. The circuit 46 can be any one of several commercially available circuits, and which will energize the LEDs 44 on command to emit light energy of the wave length of the particular LEDs. Electrical leads 48 are connected thereto and extend through the holes 34 in the bottom portion 32 of the mounting adaptor 30 for connection to a power source and switching apparatus.

Figure 4:
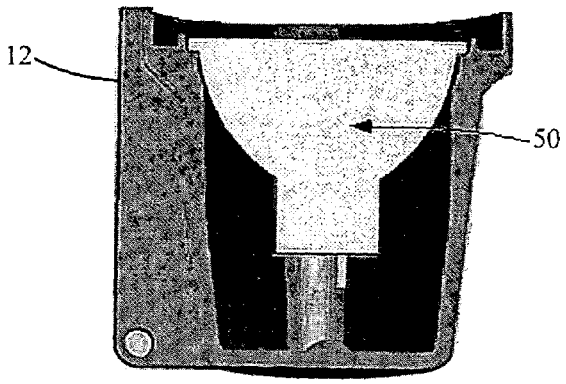
FIG. 4 is an elevational, partial cutaway view of a prior art lighting fixture showing the profile of the incandescent bulb normally disposed therein.
Figure 5:
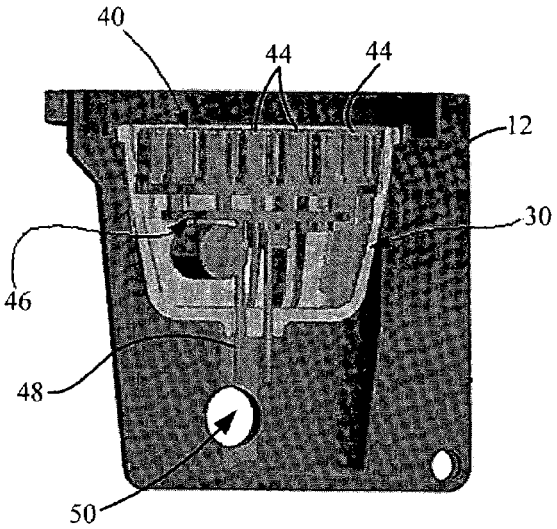
FIG. 5 shows the housing of the lighting fixture of FIG. 4 in which is installed the mounting adaptor apparatus of FIG. 3.
Figure 6:
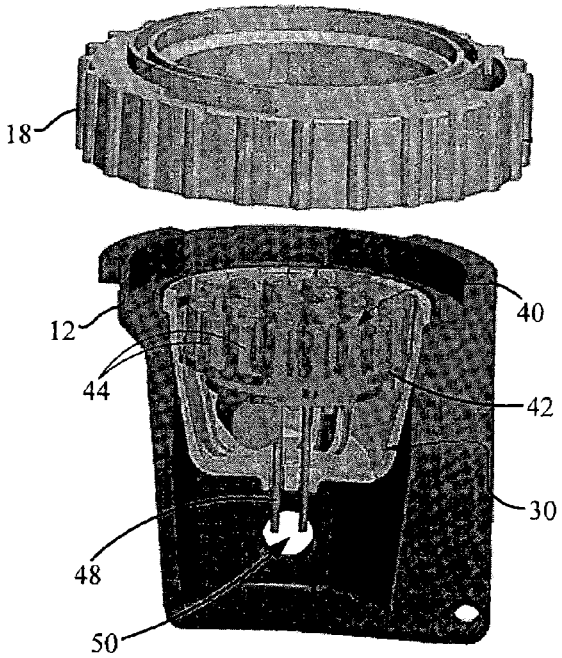
FIG. 6 is a partial cutaway, perspective view of the mounting adaptor of FIG. 5 disposed in the housing of a lighting fixture with the locking ring thereof shown prior to installing on the housing.

FIG. 4 is another view of the housing 12 and this view is included to show the lamp profile 50 of an incandescent lamp that fits in the housing 12. FIG. 5 is a similar view of the housing 12, but in this view the assembly of FIG. 3 (the mounting adaptor 30 and the PCB and LED array assembly 40) is mounted in the housing 12. As it will be noted, the mounting adaptor 30, together with the PCB and LED array assembly 40, fit the interior of the housing 12 in approximately that of the profile 50. FIG. 6, a view similar to FIG. 5, shows the locking ring 18 prior to it being installing on the housing 12.

As described herein above, the PCB and LED array assembly 40 is easily positioned within the LED mounting adaptor apparatus 30, resting on an internal shoulder thereof as shown. The locking tabs 36, acting as cantilevered springs built into the sides of the mounting adaptor 30, snap over the PCB 42 and lock it in place. Also, the housing 12 can be provided with some air holes, such as the hole 52, for the purpose of air circulation when necessary for heat dissipation.

The form and shape of the mounting adaptor, such as the mounting adaptor 30, resembles the profile of a standard type incandescent bulb so that the mounting adapter can be set into a housing, such as the housing 12, designed to accept a standard bulb. In this way a high volume production system can be used to assemble and test the LED assembly based on standard PCB assembly techniques and equipment. Maximum area is provided for the light producing components (LEDs) on the PCB. Standard mounting for the assembly can still be maintained to the light housing allowing interchangeability of incandescent bulbs and LED bulb assemblies.

The present invention provides a number of advantages over the prior art, examples of which are the following:

1. The LED mounting adaptor apparatus 30 preferably is a molded plastic part, which affords a level of mechanical shock protection not available in other prior art devices.

2. The LED mounting adaptor apparatus serves to locate and position the light emitting diodes for maximum efficiency of the emitted light (aligned with the longitudinal axis of the housing).

3. The LED mounting adaptor apparatus permits air circulation via the plurality of holes in the sides of the mount and housing, enabling the electronic circuit to stay cooler and improve reliability.

Further, examples of other embodiments of the present invention would be an assembly to replace an incandescent bulb as described but containing a variation of attachment to the PCB holding the light producing components. Protrusions from the base of the LED mount can be used to locate and hold the PCB either by attaching mounting hardware, such as screws, through the PCB and into the protrusion or a spring design as shown. This spring design would compress as pushed through a hole in the PCB and enlarge when clearing the other side of the PCB.

The present invention is thus well adapted to carry out the objects and to attain the ends and advantages mentioned and those inherent therein. While presently preferred embodiments of the invention have been described in varying detail for purposes of the disclosure, it will be understood that numerous changes may be made which will readily suggest themselves to those skilled in the art and which are encompassed within the spirit of the invention disclosed and as defined in the above text and in the accompanying drawings and the appended claims.

What is claimed is:

1. A lighting fixture assembly comprising:

a housing adapted to receive a conventional incandescent bulb;

a mounting adaptor profiled generally to the shape of the bulb and positioned in the housing; and an LED array assembly supported in the mounting adaptor, the mounting adaptor and the LED array assembly together supported in the housing;

wherein the mounting adaptor is profiled to form a nest for the LED array assembly, and the mounting adapter has a flexible locking tab engaging the LED array assembly and securing the LED array assembly to the mounting adapter.

2. The apparatus of claim 1 wherein the mounting adaptor has at least one hole to accommodate air circulation for heat dissipation.

3. The apparatus of claim 1 wherein the mounting adaptor is made from a rigid polymeric material.

* * * * *